US008003286B2

(12) United States Patent
Abe et al.

(10) Patent No.: US 8,003,286 B2
(45) Date of Patent: Aug. 23, 2011

(54) PHOTORECEPTOR FOR ELECTROPHOTOGRAPHY

(75) Inventors: Katsumi Abe, Koriyama (JP); Makoto Koike, Koriyama (JP); Atsushi Takesue, Koriyama (JP)

(73) Assignee: Hodogaya Chemical Co., Ltd., Tokyo (JP)

( * ) Notice: Subject to any disclaimer, the term of this patent is extended or adjusted under 35 U.S.C. 154(b) by 838 days.

(21) Appl. No.: 12/066,179

(22) PCT Filed: Sep. 8, 2006

(86) PCT No.: PCT/JP2006/317899

§ 371 (c)(1), (2), (4) Date: Mar. 7, 2008

(87) PCT Pub. No.: WO2007/029827

PCT Pub. Date: Mar. 15, 2007

(65) Prior Publication Data

US 2009/0104552 A1 Apr. 23, 2009

(30) Foreign Application Priority Data

Sep. 8, 2005 (JP) ..... 2005-260220

(51) Int. Cl.
*G03G 5/06* (2006.01)

(52) U.S. Cl. ..... 430/58.15; 430/56; 430/58.45; 430/58.75; 430/58.8

(58) Field of Classification Search ..... 430/58.15, 430/57.1, 58.45, 58.75, 58.8
See application file for complete search history.

(56) References Cited

U.S. PATENT DOCUMENTS 6,552,211 B2 * 4/2003 Sawano et al. ..... 556/55

FOREIGN PATENT DOCUMENTS

| | | |
|---|---|---|
| EP | 0 414 187 A2 | 2/1991 |
| EP | 0 414 187 A3 | 2/1991 |
| EP | 0 970 960 A1 | 1/2000 |
| JP | 64 44946 | 2/1989 |
| JP | 1 118845 | 5/1989 |
| JP | 3 78753 | 4/1991 |
| JP | 7 126225 | 5/1995 |
| JP | 8 110648 | 4/1996 |
| JP | 8 211636 | 8/1996 |

(Continued)

*Primary Examiner* — Christopher RoDee
*Assistant Examiner* — Rachel L Zhang
(74) *Attorney, Agent, or Firm* — Oblon, Spivak, McClelland, Maier & Neustadt, L.L.P.

(57) ABSTRACT

An object of the present invention is to provide an electrophotographic photoreceptor which is not impaired in electrophotographic properties such as charge potential and residual potential and which is also excellent in repetition stability. The invention relates to an electrophotographic photoreceptor including a conductive support having thereon a photosensitive layer containing a zirconium compound represented by the following general formula (1):

[Chem. 1]

(1)

and one or more charge transport agents having an arylamino group in its molecule.

6 Claims, 3 Drawing Sheets

FOREIGN PATENT DOCUMENTS

| | | |
|---|---|---|
| JP | 8 292587 | 11/1996 |
| JP | 9 202762 | 8/1997 |
| JP | 2002 6555 | 1/2002 |
| JP | 2002 189306 | 7/2002 |
| JP | 2002 189307 | 7/2002 |
| WO | 99 12941 | 3/1999 |

* cited by examiner

PHOTORECEPTOR FOR ELECTROPHOTOGRAPHY

TECHNICAL FIELD

The present invention relates to a photoreceptor for electrophotography. More particularly, it relates to an electrophotographic photoreceptor which shows little change in charge potential and residual potential even in repeated use and which is excellent in durability.

BACKGROUND ART

Conventionally, inorganic photoconductive substances such as selenium, zinc oxide, cadmium sulfide, and silicon have widely been used in electrophotographic photoreceptors. These inorganic substances had many advantages and simultaneously had various disadvantages. For example, selenium has the disadvantages that its production conditions are difficult and it is liable to crystallize by heat or mechanical shock. Zinc oxide and cadmium sulfide have problems in moisture resistance and mechanical strength, and have the disadvantage such that electrostatic charging and exposure deterioration take place by a coloring matter added as a sensitizer, thus lacking in durability. Silicon involves that its production conditions are difficult, cost is expensive because of using a gas having strong irritating properties, and care should be taken to its handling because of being sensitive to humidity. Additionally, selenium and cadmium sulfide have toxicity problem.

Organic photoreceptors using various organic compounds that improve the disadvantages of the inorganic photoreceptors have widely been used. Organic photoreceptors include a single layer photoreceptor having a charge generating agent and a charge transport agent dispersed in a binder resin, and a multi-layered photoreceptor having a charge generating layer and a charge transport layer functionally separated. The characteristic of such a photoreceptor called a function-separated type is that a material suitable to the respective function can be selected from a wide range. Since a photoreceptor having an optional function can easily be produced, many investigations have been carried out.

As mentioned above, although various improvements such as development of new materials and combinations thereof have been conducted for the purpose of satisfying requirements such as fundamental performance and high durability required in electrophotographic photoreceptors, it is the present situation that sufficient organic materials are not yet obtained.

However, although organic materials have many advantages that are not possessed by inorganic materials, it is the present situation that organic materials sufficiently satisfying all of the properties required in electrophotographic photoreceptors are not obtained. That is, decrease in charge potential, increase in residual potential, change in sensitivity, and the like owing to repeated use give rise to deterioration of image quality. The causes of this deterioration are not completely clarified, but active gases such as ozone and NOX generated at charging by corona discharge, decomposition of a charge transport agent or the like by ultraviolet light and heat contained in light for exposure and light for removal of electricity, and the like are considered as some factors. For suppression of the deterioration, a method of combining a hydrazone compound and an antioxidant (for example, see Patent Document 1), a method of combining a butadiene compound and an antioxidant (for example, see Patent Document 2), and the like are known. However, organic materials having good initial sensitivity do not sufficiently improve deterioration in repeated use, and organic materials having less deterioration in repeated use have the problems in initial sensitivity and charging properties. Thus, it is the present situation that the effect for suppressing deterioration is not yet sufficiently obtained.

Patent Document 1: JP-A-1-044946

Patent Document 2: JP-A-1-118845

DISCLOSURE OF THE INVENTION

Problems to be Solved by the Invention

An object of the present invention is to provide an electrophotographic photoreceptor which uses a charge transport agent having an arylamino group in its molecule and which has low residual potential in the initial state and shows suppression of increase in residual potential, prevention of decrease in charge potential, and less fatigue deterioration even in repeated use.

Means for Solving the Problem

The present invention relates to the following electrophotographic photoreceptor.

1. An electrophotographic photoreceptor comprising a conductive support having thereon a photosensitive layer containing:

a zirconium compound represented by the following general formula (1):

[Chem. 1]

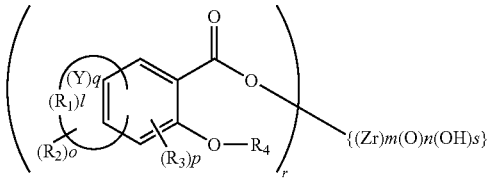

(1)

wherein $R_1$ is quaternary carbon, methine, or methylene; Y represents a cyclic structure comprising $R_1$ bonded via a saturated bond or an unsaturated bond and at least one carbon atom forming the cyclic structure may be replaced by a heteroatom selected from N, S, O, or P; $R_2$ and $R_3$ may be the same or different and each represents an alkyl group, an alkenyl group, an alkoxy group, a substituted or unsubstituted aryl group, a substituted or unsubstituted aryloxy group, a substituted or unsubstituted aralkyl group, a substituted or unsubstituted aralkyloxy group, a halogen atom, a hydrogen atom, a hydroxyl group, a substituted or unsubstituted amino group, a carboxyl group, a nitro group, a nitroso group, or a cyano group; $R_4$ represents a hydrogen atom or an alkyl group; 1 is an integer of 0 to 12; m is an integer of 1 to 20; n is an integer of 0 to 20; o is an integer of 0 to 4; p is an integer of 0 to 4; q is an integer of 0 to 3; r is an integer of 1 to 20, and s is an integer of 0 to 20; provided that when p is an integer of 2 to 4, two to four $R_3$'s may be the same or different from each other, and one or more charge transport agents having an arylamino group in its molecule.

2. The electrophotographic photoreceptor according to claim 1, wherein the charge transport agent having an arylamino group in its molecule comprises a hydrazone compound represented by the following general formula (2), (3), or (4):

[Chem. 2]

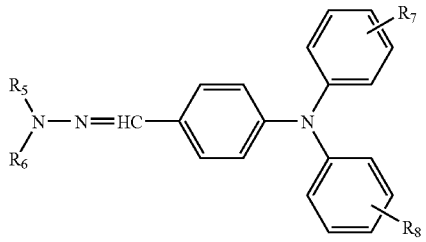

(2)

wherein $R_5$ and $R_6$ may be the same or different and each represents a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, or a substituted or unsubstituted aryl group having 1 to 4 ring numbers; $R_7$ and $R_8$ may be the same or different and each represents a hydrogen atom, a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, a linear or branched alkoxy group having 1 to 4 carbon atoms, a substituted or unsubstituted aryloxy group, an acyl group, an alkoxycarbonyl group having 2 to 5 carbon atoms, a halogen atom, a nitro group, a mono- or di-substituted amino group substituted with an alkyl group having 1 to 4 carbon atoms, or a substituted or unsubstituted amido group; and in the case where $R_5$ to $R_8$ have a substituent, they may have a halogen atom, an alkoxy group, an aryloxy group, a dialkylamino group, or an alkylthio group as the substituent and only in the case where $R_5$ or $R_6$ is an aryl group, it may have an alkyl group as the substituent;

[Chem. 3]

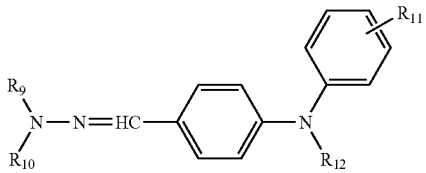

(3)

wherein $R_9$ and $R_{10}$ may be the same or different and each represents a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, or a substituted or unsubstituted aryl group having 1 to 4 ring numbers; $R_{11}$ represents a hydrogen atom, a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, a linear or branched alkoxy group having 1 to 4 carbon atoms, a substituted or unsubstituted aryloxy group, an acyl group, an alkoxycarbonyl group having 2 to 5 carbon atoms, a halogen atom, a nitro group, a mono- or di-substituted amino group substituted with an alkyl group having 1 to 4 carbon atoms, or a substituted or unsubstituted amido group; $R_{12}$ represents a linear or branched alkyl group having 1 to 12 carbon atoms, a substituted or unsubstituted linear aralkyl group having 1 to 12 carbon atoms, or a substituted or unsubstituted branched aralkyl group having 1 to 12 carbon atoms; and in the case where $R_9$ to $R_{12}$ have a substituent, they may have a halogen atom, an alkoxy group, an aryloxy group, a dialkylamino group, or an alkylthio group as the substituent and only in the case where $R_9$ or $R_{10}$ is an aryl group, it may have an alkyl group as the substituent;

[Chem. 4]

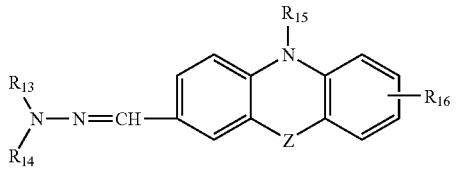

(4)

wherein Z represents a divalent group of O, S, or $N(R_{15})$; $R_{13}$ and $R_{14}$ may be the same or different and each represents a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, or a substituted or unsubstituted aryl group having 1 to 4 ring numbers; $R_{16}$ represents a hydrogen atom, a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, a linear or branched alkoxy group having 1 to 4 carbon atoms, a substituted or unsubstituted aryloxy group, an acyl group, an alkoxycarbonyl group having 2 to 5 carbon atoms, a halogen atom, a nitro group, a mono- or di-substituted amino group substituted with an alkyl group having 1 to 4 carbon atoms, or a substituted or unsubstituted amido group; $R_{15}$ represents a linear or branched alkyl group having 1 to 12 carbon atoms, a substituted or unsubstituted linear aralkyl group having 1 to 12 carbon atoms, or a substituted or unsubstituted branched aralkyl group having 1 to 12 carbon atoms; and in the case where $R_{13}$ to $R_{16}$ have a substituent, they may have a halogen atom, an alkoxy group, an aryloxy group, a dialkylamino group, or an alkylthio group as the substituent and only in the case where $R_{13}$ or $R_{14}$ is an aryl group, it may have an alkyl group as the substituent.

3. The electrophotographic photoreceptor according to claim 1, wherein the charge transport agent having an arylamino group in its molecule comprises a styryl compound represented by the following general formula (5):

[Chem. 5]

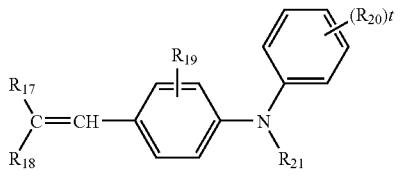

(5)

wherein $R_{17}$ and $R_{18}$ may be the same or different, each represents a substituted or unsubstituted phenyl group, a substituted or unsubstituted naphthyl group, a substituted or unsubstituted anthryl group, a substituted or unsubstituted fluorenyl group, or a substituted or unsubstituted heterocyclic group, and may have an alkyl group, an alkoxy group, a halogen atom, a hydroxyl group, or a phenyl group as a substituent, which may be further substituted; $R_{19}$ represents a hydrogen atom, a halogen group, an alkyl group, an alkoxy group, or a mono- or di-alkylamino group; $R_{20}$ represents a hydrogen atom, an alkyl group, an alkoxy group, a halogen atom, or a mono- or di-alkylamino group; t is an integer of 1 or 2 and when t is 2, the both groups may be the same or different and the both groups may be bonded to each other to form a tetramethylene ring or a trimethylene ring; and $R_{21}$ represents a substituted or unsubstituted phenyl group, which may have an alkyl group, an alkoxy group, a halogen atom, a hydroxyl group, or a substituted or unsubstituted phenyl group as a substituent, which may be further substituted.

4. The electrophotographic photoreceptor according to claim 1, wherein the charge transport agent having an arylamino group in its molecule comprises a benzidine compound represented by the following general formula (6):

[Chem. 6]

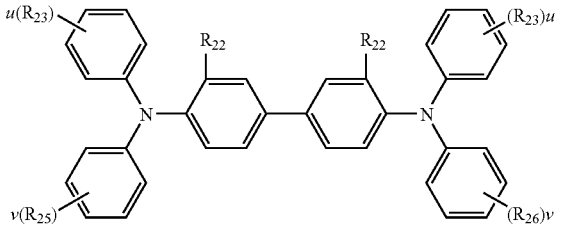

(6)

wherein $R_{22}$ represents a hydrogen atom, an alkyl group, an alkoxy group, or a halogen group; $R_{23}$, $R_{24}$, $R_{25}$, and $R_{26}$ may be the same or different and each represents a hydrogen atom, an alkyl group, an alkoxy group, a halogen atom, or a mono- or di-substituted amino group; u is an integer of 1 or 2 and when u is 2, the two groups on the same phenyl group by substitution may be the same or different; and v is an integer of 1 or 2 and when v is 2, the two groups on the same phenyl group by substitution may be the same or different.

5. The electrophotographic photoreceptor according to claim 1, wherein the charge transport agent having an arylamino group in its molecule comprises a p-terphenyl compound represented by the following general formula (7):

[Chem. 7]

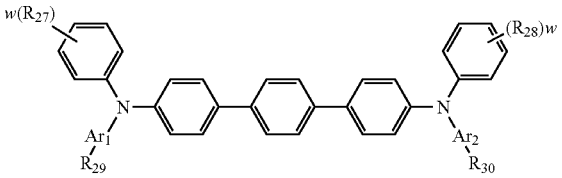

(7)

wherein $R_{27}$ and $R_{28}$ may be the same or different and each represents a hydrogen atom, an alkyl group, an alkoxy group, a halogen atom, or a mono- or di-substituted amino group; w is an integer of 1 or 2 and when w is 2, the two groups on the same phenyl group by substitution may be the same or different; $Ar_1$ and $Ar_2$ may be the same or different and each represents a divalent aromatic hydrocarbon group; and $R_{29}$ and $R_{30}$ represents a hydrogen atom, an alkyl group, an alkoxy group, a substituted or unsubstituted aralkyl group, a halogen atom, or a di-substituted amino group.

6. The electrophotographic photoreceptor according to any one of claims 1 to 5, wherein the content of the zirconium compound represented by the general formula (1) relative to the charge transport agent having an arylamino group in its molecule is from 0.01 to 0.50% by mass.

Advantage of the Invention

According to the present invention, there can be provided an electrophotographic photoreceptor which shows little change in charge potential and residual potential owing to the use of a charge transport agent having an arylamino group in its molecule in combination with a zirconium compound, and which is further excellent in repetition stability without impairing fundamental electrophotographic performances owing to less amount of the additive to be added.

DESCRIPTION OF REFERENCE NUMERALS AND SIGNS

Figure 1:
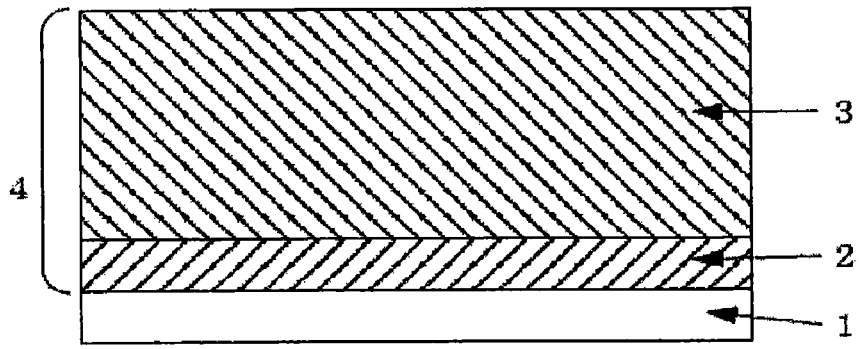
FIG. 1 is a schematic sectional view showing a layer structure of a function-separated type electrophotographic photoreceptor.

1: Conductive support
2: Charge generating layer
3: Charge transport layer
4: Photosensitive layer
5: Undercoat layer
6: Charge transport substance-containing layer
7: Charge generating substance
8: Protective layer

BEST MODE FOR CARRYING OUT THE INVENTION

Various embodiments of a photosensitive layer are present, and the photosensitive layer in the electrophotographic photoreceptor of the present invention may be any of those. Such photoreceptors are shown in FIGS. 1 to 7 as the representative examples.

Figure 2:
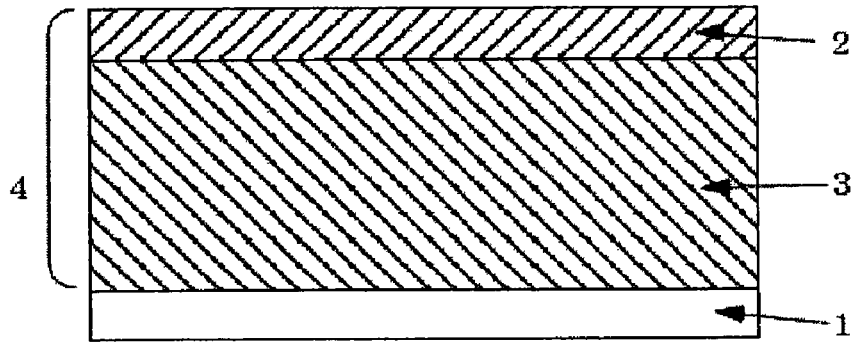
FIG. 2 is a schematic sectional view showing a layer structure of a function-separated type electrophotographic photoreceptor.
Figure 3:
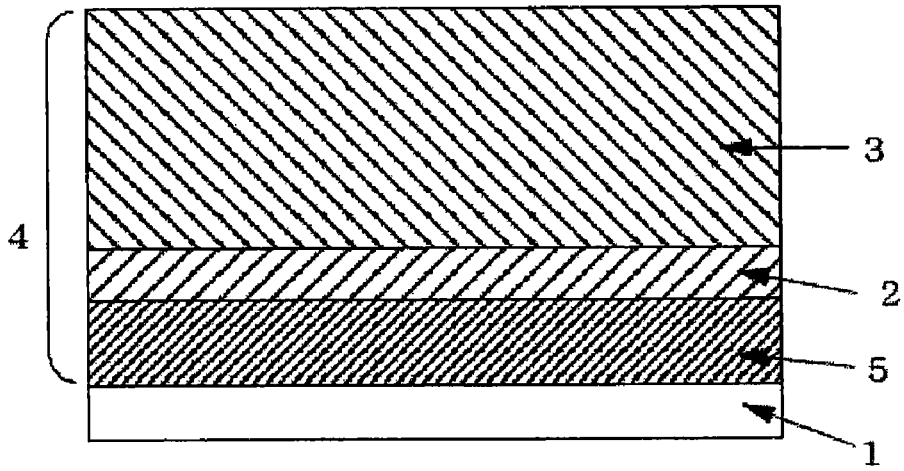
FIG. 3 is a schematic sectional view showing a layer structure of a function-separated type electrophotographic photoreceptor having an undercoat layer provided between a charge generating layer and a conductive support.
Figure 4:
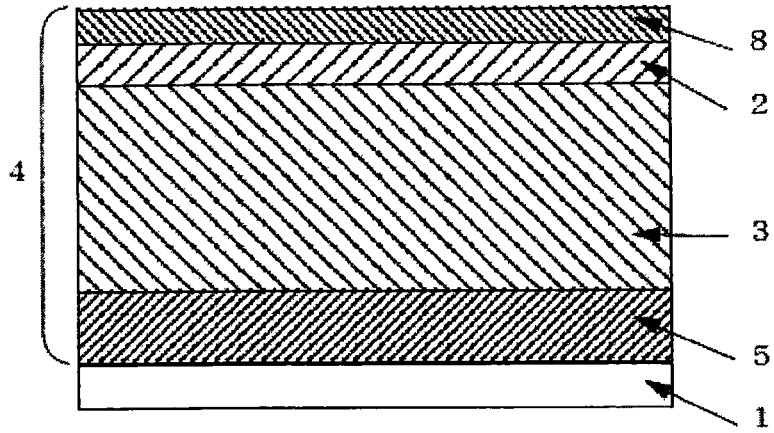
FIG. 4 is a schematic sectional view showing a layer structure of a function-separated type electrophotographic photoreceptor having an undercoat layer provided between a charge transport layer and a conductive support and having a protective layer on a charge generating layer.
Figure 5:
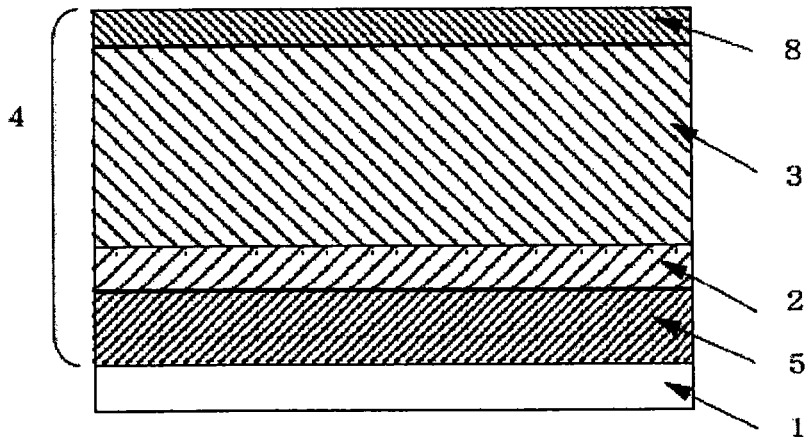
FIG. 5 is a schematic sectional view showing a layer structure of a function-separated type electrophotographic photoreceptor having an undercoat layer provided between a charge generating layer and a conductive support and having a protective layer on a charge transport layer.
Figure 6:
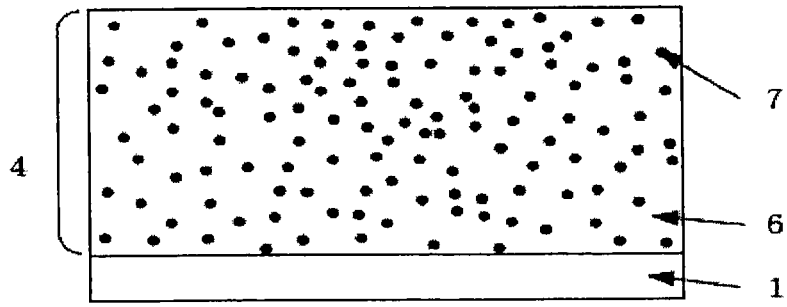
FIG. 6 is a schematic sectional view showing a layer structure of a single layer electrophotographic photoreceptor.
Figure 7:
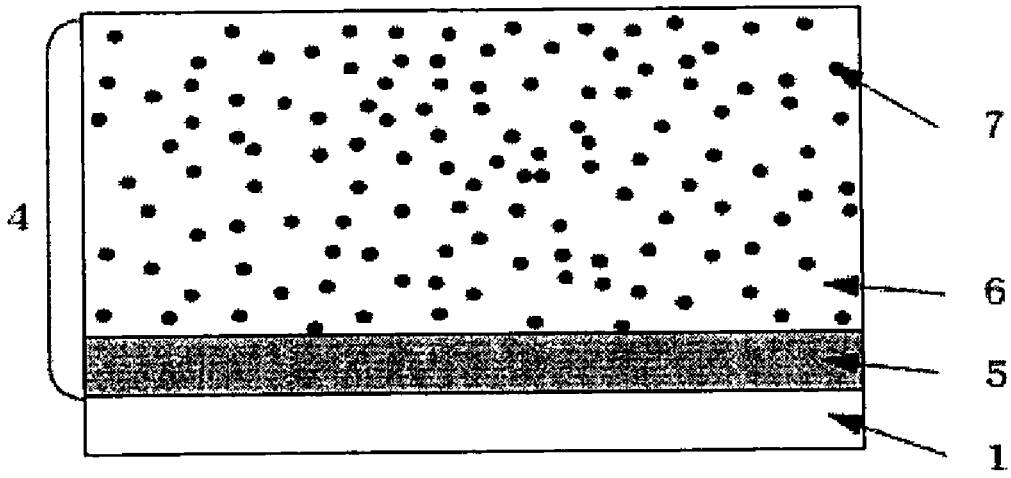
FIG. 7 is a schematic sectional view showing a layer structure of a single layer electrophotographic photoreceptor having an undercoat layer provided between a photosensitive layer and a conductive support.

FIGS. 1 and 2 show a structure comprising a conductive support 1 having provided thereon a photosensitive layer 4 comprising a laminate of a charge generating layer 2 containing a charge generating substance as a main component and a charge transport layer 3 containing a charge transport substance and a binder resin as main components. In this embodiment, as shown in FIGS. 3, 4, and 5, the photosensitive layer 4 may be provided through an undercoat layer 5 for adjusting charges provided on the conductive support, and a protective layer 8 may be provided as an outermost layer. Furthermore, in the invention, as shown in FIGS. 6 and 7, the photosensitive layer 4 comprising a charge generating substance 7 dissolved or dispersed in a layer 6 containing a charge transport substance and a binder resin as main components may be provided on the conductive support 1 directly or through the undercoat layer 5.

The photoreceptor of the invention can be prepared according to the conventional method as follows. For example, the aforementioned zirconium compound represented by the general formula (1) and one or more specific amine compounds represented by the general formulae (2) to (7) are dissolved in an appropriate solvent together with a binder resin, and according to need, charge generating substances, electron withdrawing compounds or plasticizers, pigments, and the like are added, thereby a coating liquid being prepared. This coating liquid is applied onto the conductive support and dried to form a photosensitive layer of several μm to several tens μm. Thus, a photoreceptor can be produced. When the photosensitive layer comprises two layers of a charge generating layer and a charge transport layer, the photosensitive layer can be prepared as follow: the aforementioned zirconium compound represented by the general formula (1) and one or more specific amine compounds represented by the general formulae (2) to (7) are dissolved in an appropriate solvent together with a binder resin; plasticizers, pigments, and the like are added thereto, thereby a coating liquid being prepared; and the coating liquid thus prepared is applied onto the charge generating layer, or a charge generating layer is formed on a charge transport layer obtained by applying the coating liquid. According to need, the photoreceptor thus prepared may be provided with an undercoat layer and a protective layer.

The hydrazone compounds represented by the general formulae (2) to (4) for use in the invention can be obtained using the production processes and Synthetic Examples reported in past years (for example, see Non-Patent Document 3). Moreover, the styryl compound represented by the general formula (5) for use in the invention can be obtained using the production processes and Synthetic Examples reported in past years (for example, see Non-Patent Document 4). Furthermore, the benzidine compound represented by the general formula (6) for use in the invention can be obtained using the production processes and Synthetic Examples reported in past years (for example, see Non-Patent Document 5) and the p-terphenyl compound represented by the general formula (7) for use in the invention can be obtained using the production processes and Synthetic Examples reported in past years (for example, see Non-Patent Document 5).

Patent Document 3: JP-A-9-202762
Patent Document 4: JP-A-8-211636
Patent Document 5: JP-A-7-126225

With regard to the general production process of the zirconium compound for use in the invention, the compound can be obtained by reaction using water and/or an organic solvent and using a metal-imparting agent and filtration and washing of the resulting product. Moreover, a production process has been already disclosed and reported (for example, see Non-Patent Document 6). With regard to the metal-imparting agent usable in the production of the zirconium compound, there may be mentioned halogenated zirconium compounds such as $ZrCl_4$, $ZrF_4$, $ZrBr_4$, and $ZrI_4$, organic acid zirconium compounds such as $Zr(OR)_4$ (R represents an alkyl group, an alkenyl group, or the like), inorganic acid zirconium compounds such as $Zr(SO_4)_2$, and the like in the case of tetravalent cationic bodies. In the case of divalent cationic bodies of oxo complexes, there may be mentioned inorganic acid zirconium compounds such as $ZrOCl_2$, $ZrO(NO_3)_2$, $ZrO(ClO_4)_2$, $H_2ZrO(SO_4)_2$, $ZrO(SO_4)Na_2SO_4$, and $ZrO(HPO_4)_2$, organic acid zirconium compounds such as $ZrO(CO_3)$, $(NH_4)_2ZrO(CO_3)_2$, $ZrO(C_2H_3O_2)_2$, $(NH_4)_2ZrO(C_2H_3O_2)_3$, $ZrO(C_{18}H_{35}O_2)_2$, and the like.

Patent Document 6: International Publication No.: WO99/012941

The following shows the thus obtained zirconium compounds represented by the general formula (1) for use in the invention but the compounds are not limited thereto.

TABLE 1

| Zr compound No. | 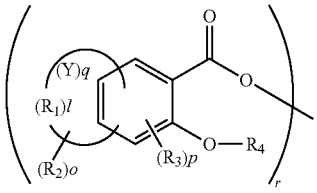 | (Zr)m(O)n(OH)s | r |
|---|---|---|---|
| 1 | 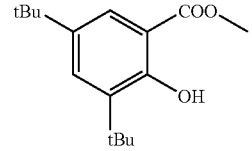 | M:4, n:4, s:3 | 5 |
| 2 | 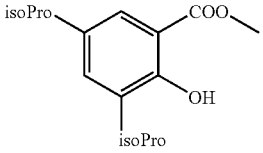 | M:4, n:4, s:3 | 5 |
| 3 | 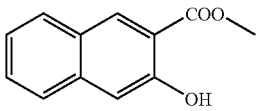 | M:4, n:4, s:3 | 5 |
| 4 | 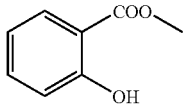 | M:4, n: 4, s:3 | 5 |
| 5 | 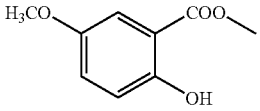 | M:4, n:4, s:3 | 5 |
| 6 | 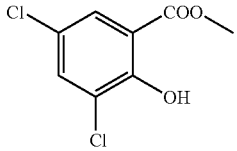 | M:4, n:4, s:3 | 5 |

TABLE 1-continued

| Zr compound No. | 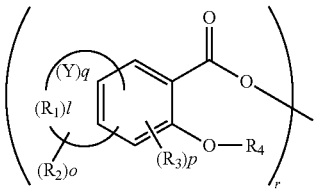 | (Zr)m(O)n(OH)s | r |
|---|---|---|---|
| 7 | 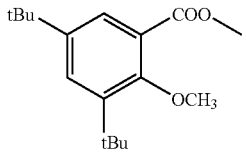 | M:4, n:4, s:3 | 5 |
| 8 | 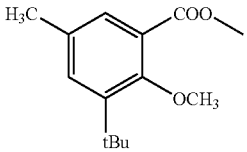 | M:4, n:4, s:3 | 5 |
| 9 | 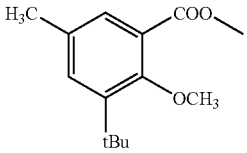 | M:4, n:4, s:3 | 4 |
| 10 | 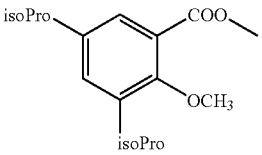 | M:4, n:4, s:3 | 4 |
| 11 | 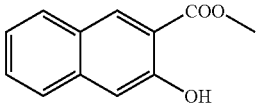 | M:4, n:4, s:3 | 4 |
| 12 | 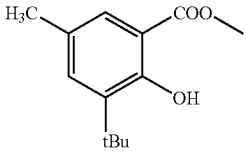 | M:4, n:4, s:3 | 4 |
| 13 | 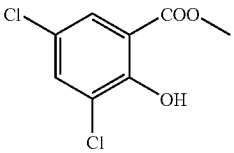 | M:4, n:4, s:3 | 4 |
| 14 | 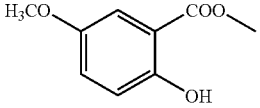 | M:4, n:4, s:3 | 4 |
| 15 | 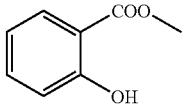 | M:4, n:4, s:3 | 4 |

TABLE 1-continued

| Zr compound No. | 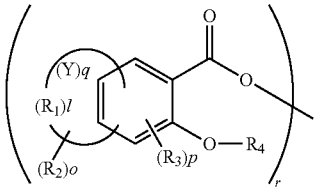 | (Zr)m(O)n(OH)s | r |
|---|---|---|---|
| 16 | 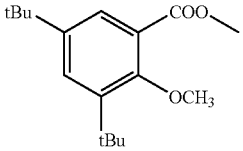 | M:4, n:4, s:3 | 4 |

A proportion of the zirconium compound in the photoreceptor of the invention is from 0.01 to 0.50% by mass based on the charge transport agent having an arylamino group in its molecule. The preferable amount to be used is the case that the proportion of the zirconium compound is from 0.05 to 0.20% by mass based on the charge transport agent.

As the conductive support on which the photosensitive layer of the invention is formed, there can be used the materials used in the well-known electrophotographic photoreceptors, for example, drums or sheets of metals such as aluminum, aluminum alloy, stainless steel, copper, zinc, vanadium, molybdenum, chromium, titanium, nickel, indium, gold, and platinum; laminates or depositions of those metals; plastic films, plastic drums, papers or paper cores, which are subjected to conducting treatment by applying a conductive substance such as metal powder, carbon black, copper iodide, and a polymer electrolyte thereto together with an appropriate binder to conduct conducting treatment; and plastic films or plastic drums, to which conductivity is imparted by incorporating a conductive substance therein.

Furthermore, according to need, an undercoat layer comprising a resin or a resin and a pigment may be provided between the conductive support and the photosensitive layer. The pigment to be dispersed in the undercoat layer may be a powder generally used, but is desirably a while pigment that does not substantially absorb near infrared light or the similar pigment in the case that it is considered to form a highly sensitized one. Examples of such a pigment include metal oxides represented by titanium oxide, zinc oxide, tin oxide, indium oxide, zirconium oxide, alumina, and silica. The metal oxides that do not have hygroscopic properties and have less environmental change are desirable.

Moreover, as a resin used in the undercoat layer, resins having high solvent resistance to general organic solvents are desirable, considering that a photosensitive layer is applied with a solvent onto the undercoat layer. Examples of such a resin include water-soluble resins such as polyvinyl alcohol, casein, and sodium polyacrylate; alcohol-soluble resins such as copolymer nylons and methoxymethylated nylons; and curable resins that form a three-dimensional network structure, such as polyurethanes, melamine resins, and epoxy resins.

The charge generating layer in the invention comprises a charge generating agent, a binder resin, and additives added according to need, and examples of its production method include a coating method, a deposition method, a CVD method, and the like.

Examples of the charge generating agent include phthalocyanine-based pigments such as various crystal titanyl phthalocyanine oxides, a titanyl phthalocyanine oxide having strong peaks at 9.3, 10.6, 13.2, 15.1, 20.8, 23.3, and 26.3 of diffraction angles 2θ±0.2° in X-ray diffraction spectrum of Cu—Kα, a titanyl phthalocyanine oxide having strong peaks at 7.5, 10.3, 12.6, 22.5, 24.3, 25.4, and 28.6 of diffraction angles 2θ±0.2°, a titanyl phthalocyanine oxide having strong peaks at 9.6, 24.1, and 27.2 of diffraction angles 2θ±0.2°, various crystal metal-free phthalocyanine such as τ-type and X-type, copper phthalocyanine, aluminum phthalocyanine, zinc phthalocyanine, α-type, β-type and Y-type oxotitanyl phthalocyanines, cobalt phthalocyanine, hydroxygallium phthalocyanine, chloroaluminum phthalocyanine, and chloroindium phthalocyanine; azo-based pigments such as an azo pigment having a triphenylamine skeleton (for example, see Patent Document 7), an azo pigment having a carbazole skeleton (for example, see Patent Document 8), an azo pigment having a fluorene skeleton (for example, see Patent Document 9), an azo pigment having an oxadiazole skeleton (for example, see Patent Document 10), an azo pigment having a bisstilbene skeleton (for example, see Patent Document 11), an azo pigment having a dibenzothiophene skeleton (for example, see Patent Document 12), an azo pigment having a distyrylbenzene skeleton (for example, see Patent Document 13), an azo pigment having a distyrylcarbazole skeleton (for example, see Patent Document 14), an azo pigment having a distyryloxadiazole skeleton (for example, see Patent Document 15), an azo pigment having a stilbene skeleton (for example, see Patent Document 16), a trisazo pigment having a carbazole skeleton (for example, see Patent Documents 17 and 18), an azo pigment having an anthraquinone skeleton (for example, see Patent Document 19), and a bisazo pigment having a diphenylpolyene skeleton (for example, see Patent Document 20 to 24); perylene pigments such as perylenic acid anhydride and perylenic acid imide; polycyclic quinone pigments such as anthraquinone derivatives, anthanthrone derivatives, dibenzpyrenequinone derivatives, pyranthrone derivatives, violanthrone derivatives, and isoviolanthrone derivatives; diphenylmethane- and triphenylmethane-based pigments; cyanine- an azomethine-based pigments; indigo-based pigments; bisbenzimidazole-based pigments; azulenium salts; pyrylium salts; thiapyrylium salts; benzopyrylium salts; and squarylium salts. They may be used singly or as a mixture of two or more thereof according to need.

Patent Document 7: JP-A-53-132347
Patent Document 8: JP-A-53-095033
Patent Document 9: JP-A-54-022834
Patent Document 10: JP-A-54-012742
Patent Document 11: JP-A-54-017733
Patent Document 12: JP-A-54-021728
Patent Document 13: JP-A-53-133445
Patent Document 14: JP-A-54-017734
Patent Document 15: JP-A-54-002129
Patent Document 16: JP-A-53-138229
Patent Document 17: JP-A-57-195767
Patent Document 18: JP-A-57-195768
Patent Document 19: JP-A-57-202545
Patent Document 20: JP-A-59-129857
Patent Document 21: JP-A-62-267363
Patent Document 22: JP-A-64-079753
Patent Document 23: JP-B-3-034503
Patent Document 24: JP-B-4-052459

The binder resin to be used in the charge generating layer is not particularly limited, and examples thereof include polycarbonates, polyarylates, polyesters, polyamides, polyethylene, polystyrene, polyacrylates, polymethacrylates, polyvinyl butyral, polyvinyl acetal, polyvinyl formal, polyvinyl alcohol, polyacrylonitrile, polyacrylamide, styrene-acryl copolymers, styrene-maleic anhydride copolymers, acrylonitrile-butadiene copolymers, polysulfones, polyether sulfones, silicon resins, and phenoxy resins. They may be used singly or as a mixture of two or more thereof according to need.

Examples of the additives to be used according to need include antioxidants, ultraviolet absorbers, light stabilizers, dispersing agents, pressure-sensitive adhesives, and sensitizers. The film thickness of the charge generating layer prepared using the above materials is from 0.1 to 2.0 μm, and preferably from 0.1 to 1.0 μm. The charge transport layer in the invention can be formed by dissolving a charge transport agent, a binder resin and according to need, an electron accepting substance, and additives in a solvent, applying the resulting solution onto the charge generating layer or the conductive support or onto the undercoat layer, and drying the solution.

Materials to be used as a binder resin for the charge transport layer include polymers or copolymers of vinyl compound(s) such as styrene, vinyl acetate, vinyl chloride, acrylic esters, methacrylic esters, and butadiene, and various resins having compatibility with the charge transport agent and the additive, such as polyvinyl acetal, polycarbonates (for example, see Patent Documents 25 to 28), polyesters, polyphenylene oxide, polyurethane cellulose esters, phenoxy resins, silicon resins, and epoxy resins. They may be used singly or as a mixture of two or more thereof according to need. Amount of the binder resin to be used is usually from 0.4 to 10 mass equivalents, and preferably from 0.5 to 5 mass equivalents to the charge transport agent. Specific examples of particularly effective resins include polycarbonate-based resins such as "IUPILON Z" (manufactured by Mitsubishi Engineering-Plastics Corporation) and "bisphenol A-biphenol copolycarbonate" (manufactured by Idemitsu Kosan Co., Ltd.).

Patent Document 25: JP-A-60-172044
Patent Document 26: JP-A-62-247374
Patent Document 27: JP-A-63-148263
Patent Document 28: JP-A-2-254459

The solvent to be used for the charge transport layer is not particularly limited so long as it dissolves a charge transport agent, a binder resin, an electron accepting substance, and additives. For example, there can be used polar organic solvents such as tetrahydrofuran, 1,4-dioxane, methyl ethyl ketone, cyclohexanone, acetonitrile, N,N-dimethylformamide, and ethyl acetate; aromatic organic solvents such as toluene, xylene, and chlorobenzene; and chlorine-based hydrocarbon solvents such as chloroform, trichloroethylene, dichloromethane, 1,2-dichloroethane, and carbon tetrachloride. They may be used singly or as a mixture of two or more thereof according to need.

Moreover, the photosensitive layer of the invention can contain an electron accepting substance for the purpose of improvement in sensitivity, decrease in residual potential, or reduction of fatigue in repeated use. Examples of the electron accepting substance include succinic anhydride, maleic anhydride, dibromosuccinic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picryl chloride, quinonechloroimide, chloranil, bromanil, dichlorodicyano-p-benzoquinone, anthraquinone, dinitroanthraquinone, 2,3-dichloro-1,4-naphthoquinone, 1-nitroanthraquinone, 2-chloroanthraquinone, phenanthrenequinone, terephthalal malenonitrile, 9-anthrylmethylidene malenonitrile, 9-fluorenylidene malononitrile, polynitro-9-fluorenylidene malononitrile, 4-nitrobenzaldehyde, 9-benzoylanthracene, indanedione, 3,5-dinitrobenzophenone, 4-chloronaphthalic anhydride, 3-benzalphthalide, 3-α-cyano-p-nitrobenzal)-4,5,6,7-tetrachlorophthalide, picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid, and other compounds having large electron affinity.

According to need, a surface protective layer may be provided on the surface of the photoreceptor. Materials that can be used for the layer include resins such as polyesters and polyamides, and mixtures of those resins and metals, metal oxides, and the like that can control electric resistance. The surface protective layer is desirably transparent as much as possible in a wavelength region of light absorption of the charge generating agent.

The present invention will be illustrated in detail with reference to the following Examples, but the invention should not be construed as being limited to those Examples. In the Examples, "part" means "part by mass", and concentration shown is in terms of "% by mass".

Example 1

One part of an alcohol-soluble polyamide (AMILAN CM-400, manufactured by Toray Industries, Inc.) was dissolved in 13 parts of methanol. Five parts of titanium oxide (TIPAQUE CR-EL, manufactured by Ishihara Sangyo Kaisha, Ltd.) was added thereto and was dispersed by means of a paint shaker for 8 hours to prepare a coating liquid for an undercoat layer. Thereafter, the coating liquid was applied to an aluminum surface of an aluminum-deposited PET film using a wire bar to form an undercoat layer having a thickness of 1 μm.

Then, 1.5 parts of a titanyl phthalocyanine oxide (charge generating agent No. 1):

[Chem. 8]

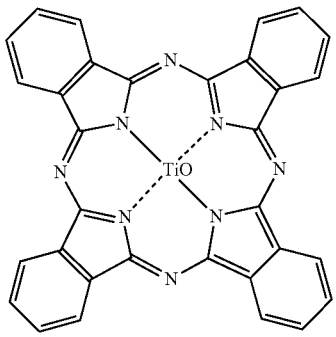

having strong peaks at 7.5, 10.3, 12.6, 22.5, 24.3, 25.4, and 28.6 of diffraction angles 2θ±0.2° in X-ray diffraction spectrum of Cu—Kα was added to 50 parts of a 3% cyclohexanone solution of a polyvinyl butyral resin (S-LEC BL-S, manufactured by Sekisui Chemical Co., Ltd.), and dispersed by means of an ultrasonic dispersing machine for 1 hour. The dispersion obtained was applied onto the aforementioned undercoat layer using a wire bar, and dried at 110° C. under atmospheric pressure for 1 hour to form a charge generating layer having a thickness of 0.6 μm.

On the other hand, 0.1 part of the zirconium compound (Zr compound No. 1) and 100 parts of the following benzidine compound (charge transport agent No. 1):

[Chem. 9]

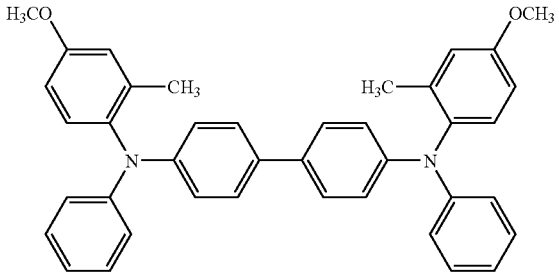

as a charge transport agent were added to 962 parts of a 13.0% tetrahydrofuran solution of a polycarbonate resin (IUPILON Z, manufactured by Mitsubishi Engineering-Plastics Corporation), and the additive and the charge transport agent were completely dissolved by applying ultrasonic wave. This solution was applied to the aforementioned charge generating layer with a wire bar, and dried at 110° C. under atmospheric pressure for 30 minutes to form a charge transport layer having a thickness of 20 μm, thereby, a photoreceptor being prepared.

Comparative Example 1

A photoreceptor for comparison was prepared in the same manner as in Example 1, except that the Zr compound No. 1 was eliminated in Example 1.

Example 2

A photoreceptor was prepared in the same manner as in Example 1, except that a titanyl phthalocyanine oxide (charge generating agent No. 2) having strong peaks at 9.6, 24.1, and 27.2 of diffraction angles 2θ±0.2° in X-ray diffraction spectrum of Cu—Kα was used in place of the charge generating agent No. 1 and the following p-terphenyl compound (charge transport agent No. 2):

[Chem. 10]

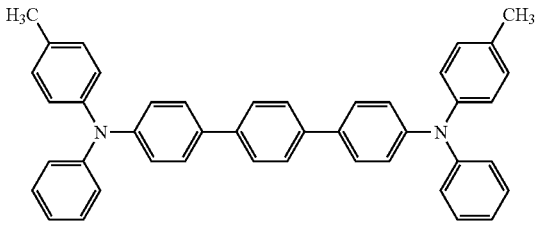

was used in place of the charge transport agent No. 1.

Comparative Example 2

A photoreceptor for comparison was prepared in the same manner as in Example 2, except that the Zr compound No. 2 was eliminated in Example 2.

Example 3

Ten parts of an alcohol-soluble polyamide (AMILAN CM-8000, manufactured by Toray Industries, Inc.) was dissolved in 190 parts of methanol. The resulting solution was applied to an aluminum surface of an aluminum-deposited PET film using a wire bar, and dried to form an undercoat layer having a thickness of 1 μm.

Then, 1.5 parts of the following τ-type metal-free phthalocyanine (charge generating agent No. 3):

[Chem. 11]

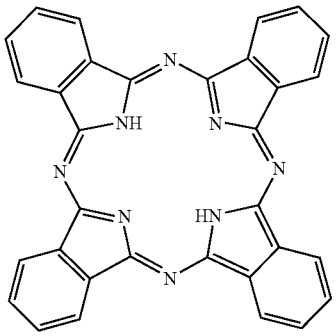

as a charge generating agent was added to 50 parts of a 3% cyclohexanone solution of a polyvinyl butyral resin (S-LEC BL-S, manufactured by Sekisui Chemical Co., Ltd.), and dispersed by means of an ultrasonic dispersing machine for 1 hour. The dispersion obtained was applied to the aforementioned undercoat layer using a wire bar, and dried at 110° C. under atmospheric pressure for 1 hour to form a charge generating layer having a thickness of 0.6 μm.

On the other hand, 0.1 part of the zirconium compound (Zr compound No. 1) and 100 parts of the following hydrazone compound (charge transport agent No. 3):

[Chem. 12]

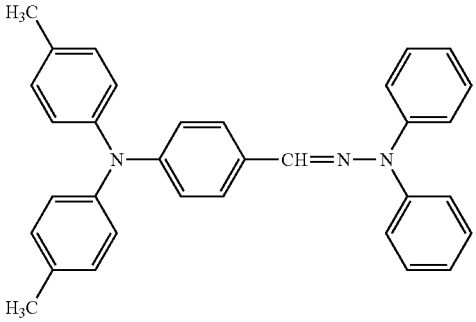

as a charge transport agent were added to 962 parts of a 13.0% tetrahydrofuran solution of a polycarbonate resin (IUPILON Z, manufactured by Mitsubishi Engineering-Plastics Corporation), and the additive and the charge transport agent were completely dissolved by applying ultrasonic wave. This solution was applied to the aforementioned charge generating layer with a wire bar, and dried at 110° C. under atmospheric pressure for 30 minutes to form a charge transport layer having a thickness of 20 μm, thereby, a photoreceptor being prepared.

Comparative Example 3

A photoreceptor for comparison was prepared in the same manner as in Example 3, except that the Zr compound No. 1 was eliminated in Example 3.

Example 4

A photoreceptor was prepared in the same manner as in Example 2, except that a mixture of the following styryl compound (charge transport agent No. 4):

[Chem. 13]

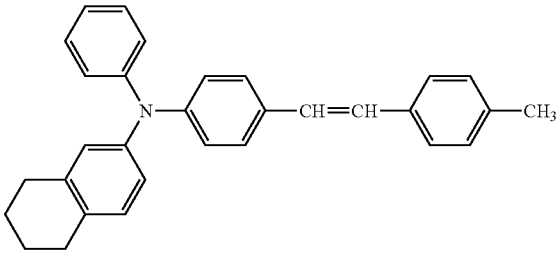

and the following styryl compound (charge transport agent No. 5):

[Chem. 14]

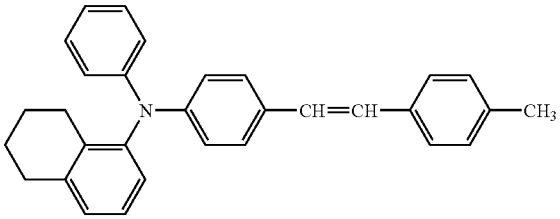

in a mass ratio of 1:1 was used in place of the charge transport agent No. 2 in Example 2.

Comparative Example 4

A photoreceptor for comparison was prepared in the same manner as in Example 4, except that the Zr compound No. 1 was eliminated in Example 4.

Example 5

To 83 parts of cyclohexanone were added 1.0 part of the following bisazo pigment (charge generating agent No. 4):

[Chem. 15]

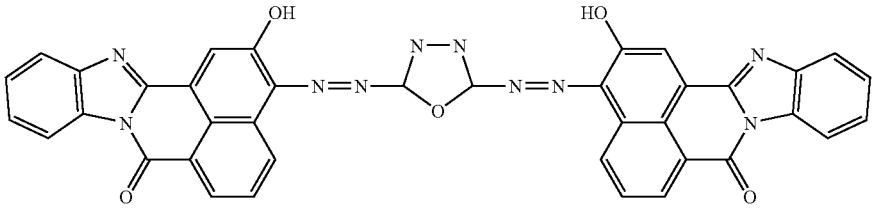

as a charge generating agent and 8.6 parts of a 5% cyclohexanone solution of a polyvinyl butyral resin (S-LEC BL-S, manufactured by Sekisui Chemical Co., Ltd.), and then grinding and dispersing treatment was conducted in a ball mill for 48 hours. The dispersion obtained was applied to an aluminum surface of an aluminum-deposited PET film as a conductive support using a wire bar, and dried to form a charge generating layer having a thickness of 0.8 μm.

On the other hand, 0.1 part of the Zr compound No. 1 and 100 parts of a mixture of the following styryl compound (charge transport agent No. 6):

[Chem. 16]

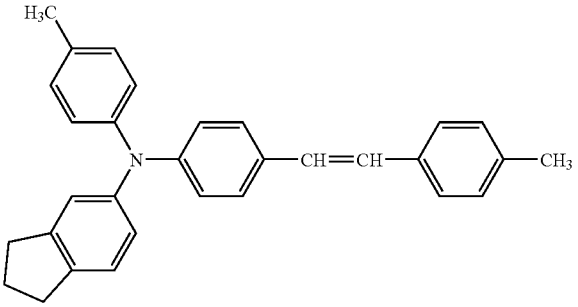

and the following styryl compound (charge transport agent No. 7):

[Chem. 17]

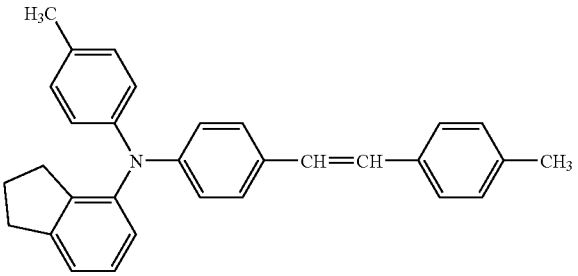

in a mass ratio of 9:1 were added to 962 parts of a 13.0% tetrahydrofuran solution of a polycarbonate resin (IUPILON Z, manufactured by Mitsubishi Engineering-Plastics Corporation), and the additive and the p-terphenyl compound were completely dissolved by applying ultrasonic wave. This solution was applied to the aforementioned charge generating layer with a wire bar, and dried at 110° C. under atmospheric pressure for 30 minutes to form a charge transport layer having a thickness of 20 μm, thereby, a photoreceptor being prepared.

Comparative Example 5

A photoreceptor for comparison was prepared in the same manner as in Example 5, except that the Zr compound No. 1 was eliminated in Example 5.

Example 6

Electrophotographic properties of the photoreceptors prepared in Examples 1 to 4 and Comparative Examples 1 to 4 were evaluated using a photosensitive drum property-measuring apparatus (trade name: ELYSIA-II, manufactured by TREK JAPAN K.K.). First, the photoreceptor was subjected to corona discharge of −5.7 kV in a dark place. Subsequently, an erase lamp of 70 lux was lighted and charge potential V0 at this time was measured. Next, the photoreceptor was exposed with monochromatic light of image exposure 780 nm-30 μW to determine residual potential Vr. Then, charge potential V0 and residual potential Vr were measured after the aforementioned charging and exposure were repeated 1000 times. The results are shown in Table 2.

TABLE 2

| Example and Comparative Example | Charge generating agent No. | Charge transport agent No. | Zr Compound No. | Charge potential V0 (−V) Initial | Charge potential V0 (−V) Repetition 1000 times | Residual potential Vr (−V) Initial | Residual potential Vr (−V) Repetition 1000 times |
|---|---|---|---|---|---|---|---|
| Example 1 | 1 | 1 | 1 | 625 | 620 | 12 | 12 |
| Com. Ex. 1 | 1 | 1 | — | 630 | 610 | 26 | 23 |
| Example 2 | 2 | 2 | 1 | 680 | 665 | 10 | 9 |
| Com. Ex. 2 | 2 | 2 | — | 676 | 643 | 15 | 10 |
| Example 3 | 3 | 3 | 1 | 660 | 660 | 14 | 23 |
| Com. Ex. 3 | 3 | 3 | — | 660 | 670 | 20 | 45 |
| Example 4 | 2 | 4, 5 | 1 | 670 | 670 | 19 | 20 |
| Com. Ex. 4 | 2 | 4, 5 | — | 663 | 680 | 31 | 46 |

Example 7

Electrophotographic properties of the photoreceptors prepared in Example 5 and Comparative Example 5 were evaluated using a photosensitive drum property-measuring apparatus (trade name: ELYSIA-II, manufactured by TREK JAPAN). First, the photoreceptor was subjected to corona discharge of −5.0 kV in a dark place. Subsequently, an erase lamp of 70 lux was lighted and charge potential V0 at this time was measured. Next, the photoreceptor was exposed with white light of image exposure 40 lux to determine residual potential Vr. Then, charge potential V0 and residual potential Vr were measured after the aforementioned charging and exposure were repeated 1000 times. The results are shown in Table 3.

TABLE 3

| Example and Comparative Example | Charge generating agent No. | Charge transport agent No. | Zr Compound No. | Charge potential V0 (−V) Initial | Charge potential V0 (−V) Repetition 1000 times | Residual potential Vr (−V) Initial | Residual potential Vr (−V) Repetition 1000 times |
|---|---|---|---|---|---|---|---|
| Example 5 | 4 | 6, 7 | 1 | 700 | 700 | 6 | 6 |
| Com. Ex. 5 | 4 | 6, 7 | — | 700 | 710 | 7 | 13 |

As described above, there can be provided an electrophotographic photoreceptor, which shows little change in charge potential and residual potential and which is excellent in durability, by using a charge transport agent having an arylamino group in its molecule and a zirconium compound in combination.

While the invention has been described in detail and with reference to specific embodiments thereof, it will be apparent to one skilled in the art that various changes and modifications can be made therein without departing from the spirit and scope thereof.

The present application is based on Japanese Patent Application No. 2005-260220 filed on Sep. 8, 2005, and the contents thereof are incorporated herein by reference.

INDUSTRIAL APPLICABILITY

The electrophotographic photoreceptor of the present invention is useful as an electrophotographic photoreceptor which has low residual potential even in the initial state and shows little change in electrophotographic properties and which is capable of realizing high durability.

The invention claimed is:

1. An electrophotographic photoreceptor comprising a conductive support having thereon a photosensitive layer containing:

a zirconium compound represented by the following general formula (1):

[Chem. 1]

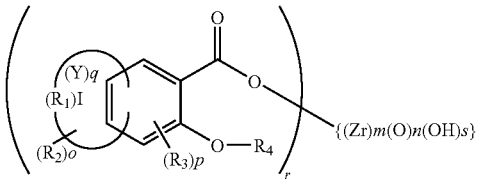

(1)

wherein $R_1$ is quaternary carbon, methine, or methylene; Y represents a cyclic structure comprising $R_1$ bonded via a saturated bond or an unsaturated bond and at least one carbon atom forming the cyclic structure may be replaced by a heteroatom selected from N, S, O, or P; $R_2$ and $R_3$ may be the same or different and each represents an alkyl group, an alkenyl group, an alkoxy group, a substituted or unsubstituted aryl group, a substituted or unsubstituted aryloxy group, a substituted or unsubstituted aralkyl group, a substituted or unsubstituted aralkyloxy group, a halogen atom, a hydrogen atom, a hydroxyl group, a substituted or unsubstituted amino group, a carboxyl group, a nitro group, a nitroso group, or a cyano group; $R_4$ represents a hydrogen atom or an alkyl group; l is an integer of 0 to 12; m is an integer of 1 to 20; n is an integer of 0 to 20; o is an integer of 0 to 4; p is an integer of 0 to 4; q is an integer of 0 to 3; r is an integer of 1 to 20, and s is an integer of 0 to 20; provided that when p is an integer of 2 to 4, two to four $R_3$'s may be the same or different from each other, and one or more charge transport agents having an arylamino group in its molecule.

2. The electrophotographic photoreceptor according to claim 1, wherein the charge transport agent having an arylamino group in its molecule comprises a hydrazone compound represented by the following general formula (2), (3), or (4):

[Chem. 2]

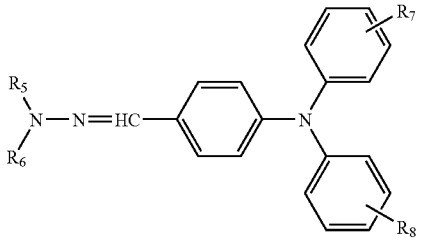

(2)

wherein $R_5$ and $R_6$ may be the same or different and each represents a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, or a substituted or unsubstituted aryl group having 1 to 4 ring numbers; $R_7$ and $R_8$ may be the same or different and each represents a hydrogen atom, a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, a linear or branched alkoxy group having 1 to 4 carbon atoms, a substituted or unsubstituted aryloxy group, an acyl group, an alkoxycarbonyl group having 2 to 5 carbon atoms, a halogen atom, a nitro group, a mono- or di-substituted amino group substituted with an alkyl group having 1 to 4 carbon atoms, or a substituted or unsubstituted amido group; and in the case where $R_5$ to $R_8$ have a substituent, they may have a halogen atom, an alkoxy group, an aryloxy group, a dialkylamino group, or an alkylthio group as the substituent and only in the case where $R_5$ or $R_6$ is an aryl group, it may have an alkyl group as the substituent;

[Chem. 3]

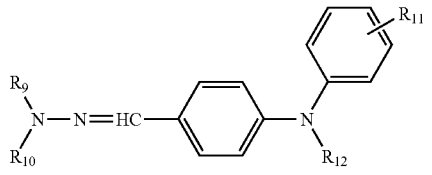

(3)

wherein $R_9$ and $R_{10}$ may be the same or different and each represents a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, or a substituted or unsubstituted aryl group having 1 to 4 ring numbers; $R_{11}$ represents a hydrogen atom, a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, a linear or branched alkoxy group having 1 to 4 carbon atoms, a substituted or unsubstituted aryloxy group, an acyl group, an alkoxycarbonyl group having 2 to 5 carbon atoms, a halogen atom, a nitro group, a mono- or di-substituted amino group substituted with an alkyl group having 1 to 4 carbon atoms, or a substituted or unsubstituted amido group; $R_{12}$ represents a linear or branched alkyl group having 1 to 12 carbon atoms, a substituted or unsubstituted linear aralkyl group having 1 to 12 carbon atoms, or a substituted or unsubstituted branched aralkyl group having 1 to 12 carbon atoms; and in the case where $R_9$ to $R_{12}$ have a substituent, they may have a halogen atom, an alkoxy group, an aryloxy group, a dialkylamino group, or an alkylthio group as the substituent and only in the case where $R_9$ or $R_{10}$ is an aryl group, it may have an alkyl group as the substituent;

[Chem. 4]

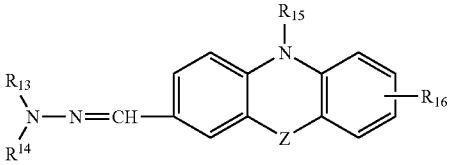

(4)

wherein Z represents a divalent group of O, S, or $N(R_{15})$; $R_{13}$ and $R_{14}$ may be the same or different and each represents a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, or a substituted or unsubstituted aryl group having 1 to 4 ring numbers; $R_{16}$ represents a hydrogen atom, a linear or branched alkyl group having 1 to 12 carbon atoms, a substituted or unsubstituted linear aralkyl group having 7 to 20 carbon atoms, a substituted or unsubstituted branched aralkyl group having 7 to 20 carbon atoms, a linear or branched alkoxy group having 1 to 4 carbon atoms, a substituted or unsubstituted aryloxy group, an acyl group, an alkoxycarbonyl group having 2 to 5 carbon atoms, a halogen atom, a nitro group, a mono- or di-substituted amino group substituted with an alkyl group having 1 to 4 carbon atoms, or a substituted or unsubstituted amido group; $R_{15}$ represents a linear or branched alkyl group having 1 to 12 carbon atoms, a substituted or unsubstituted linear aralkyl group having 1 to 12 carbon atoms, or a substituted or unsubstituted branched aralkyl group having 1 to 12 carbon atoms; and in the case where $R_{13}$ to $R_{16}$ have a substituent, they may have a halogen atom, an alkoxy group, an aryloxy group, a dialkylamino group, or an alkylthio group as the substituent and only in the case where $R_{13}$ or $R_{14}$ is an aryl group, it may have an alkyl group as the substituent.

3. The electrophotographic photoreceptor according to claim 1, wherein the charge transport agent having an arylamino group in its molecule comprises a styryl compound represented by the following general formula (5):

[Chem. 5]

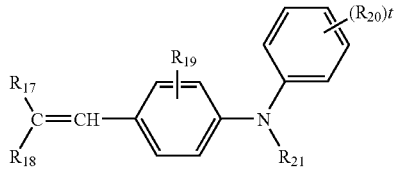

(5)

wherein $R_{17}$ and $R_{18}$ may be the same or different, each represents a substituted or unsubstituted phenyl group, a substituted or unsubstituted naphthyl group, a substituted or unsubstituted anthryl group, a substituted or unsubstituted fluorenyl group, or a substituted or unsubstituted heterocyclic group, and may have an alkyl group, an alkoxy group, a halogen atom, a hydroxyl group, or a phenyl group as a substituent, which may be further substituted; $R_{19}$ represents a hydrogen atom, a halogen group, an alkyl group, an alkoxy group, or a mono- or di-alkylamino group; $R_{20}$ represents a hydrogen atom, an alkyl group, an alkoxy group, a halogen atom, or a mono- or di-alkylamino group; t is an integer of 1 or 2 and when t is 2, the both groups may be the same or different and the both groups may be bonded to each other to form a tetramethylene ring or a trimethylene ring; and $R_{21}$ represents a substituted or unsubstituted phenyl group, which may have an alkyl group, an alkoxy group, a halogen atom, a hydroxyl group, or a substituted or unsubstituted phenyl group as a substituent, which may be further substituted.

4. The electrophotographic photoreceptor according to claim 1, wherein the charge transport agent having an arylamino group in its molecule comprises a benzidine compound represented by the following general formula (6):

[Chem. 6]

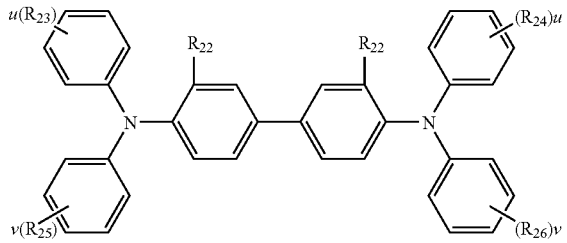

(6)

wherein $R_{22}$ represents a hydrogen atom, an alkyl group, an alkoxy group, or a halogen group; $R_{23}$, $R_{24}$, $R_{25}$, and $R_{26}$ may be the same or different and each represents a hydrogen atom, an alkyl group, an alkoxy group, a halogen atom, or a mono- or di-substituted amino group; u is an integer of 1 or 2 and when u is 2, the two groups on the same phenyl group by substitution may be the same or different; and v is an integer of 1 or 2 and when v is 2, the two groups on the same phenyl group by substitution may be the same or different.

5. The electrophotographic photoreceptor according to claim 1, wherein the charge transport agent having an arylamino group in its molecule comprises a p-terphenyl compound represented by the following general formula (7):

[Chem. 7]

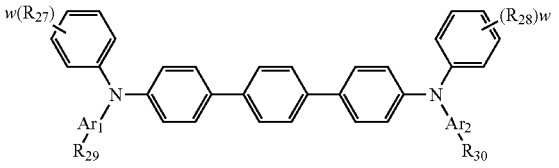

(7)

wherein $R_{27}$ and $R_{28}$ may be the same or different and each represents a hydrogen atom, an alkyl group, an alkoxy group, a halogen atom, or a mono- or di-substituted amino group; w is an integer of 1 or 2 and when w is 2, the two groups on the same phenyl group by substitution may be the same or different; $Ar_1$ and $Ar_2$ may be the same or different and each represents a divalent aromatic hydrocarbon group; and $R_{29}$ and $R_{30}$ represents a hydrogen atom, an alkyl group, an alkoxy group, a substituted or unsubstituted aralkyl group, a halogen atom, or a di-substituted amino group.

6. The electrophotographic photoreceptor according to any one of claims 1 to 5, wherein the content of the zirconium compound represented by the general formula (1) relative to the charge transport agent having an arylamino group in its molecule is from 0.01 to 0.50% by mass.

* * * * *